United States Patent [19]

Voss

[11] Patent Number: 4,622,679

[45] Date of Patent: Nov. 11, 1986

[54] CORELESS INDUCTION FURNACE

[75] Inventor: Lorenz Voss, Monschau, Fed. Rep. of Germany

[73] Assignee: Otto Junker GmbH, Simmerath, Fed. Rep. of Germany

[21] Appl. No.: 698,629

[22] Filed: Feb. 6, 1985

[30] Foreign Application Priority Data

Feb. 14, 1984 [DE] Fed. Rep. of Germany ..... 3405120

[51] Int. Cl.[4] ..... H05B 5/16

[52] U.S. Cl. ..... 373/152; 373/153; 373/156; 336/207

[58] Field of Search ..... 373/141, 152–158; 336/199, 205, 206, 207; 219/10.79

[56] References Cited

U.S. PATENT DOCUMENTS

| | | | |
|---|---|---|---|
| 2,085,450 | 6/1937 | Rohn | 373/152 |
| 3,300,565 | 1/1967 | Junker | 373/156 X |
| 4,152,187 | 5/1979 | Caudill et al. | 373/152 |

FOREIGN PATENT DOCUMENTS

| | | |
|---|---|---|
| 496462 | 4/1930 | Fed. Rep. of Germany . |
| 2420533 | 4/1974 | Fed. Rep. of Germany . |

*Primary Examiner*—Roy N. Envall, Jr.
*Attorney, Agent, or Firm*—Michael J. Striker

[57] ABSTRACT

In a vacuum induction furnace provided with an induction coil, surrounding a furnace crucible, the coil includes a plurality of intermediate layers inserted between the individual windings, and spacer elements also inserted between the individual windings, next to the intermediate layers and at the side of the coil facing the crucible. The spacer elements are formed of insulating material.

22 Claims, 4 Drawing Figures

CORELESS INDUCTION FURNACE

BACKGROUND OF THE INVENTION

The present invention relates to a coreless induction furnace for processing metal or metal melts, such as melting of metals or holding heat in metals, particularly in vacuum or under overpressure.

Induction furnaces of the foregoing type include a cooled induction coil, the windings of which together with intermediate layers of flexible gas-tight material, such as rubber, inserted between the windings, form a portion of the outer gas-sealed jacket of the furnace crucible. The windings of the coil and its intermediate layers are compressed in the axial direction of the coil by a clamping device.

The induction coil of the type under consideration is disclosed in DE-PS No. 496,462. This coil includes intermediate layers of, for example rubber, inserted between the windings of the coil and surrounding the interior of the furnace crucible. The whole arrangement comprised of the coil windings and intermediate layers is compressed by means of a special arrangement which is engaged with lower and upper plates provided on the end sides of the induction coil. Since the pressure, with which the windings and the intermediate layers are pressed together, is to be high in order to obtain a gas-sealed jacket of the crucible of the furnace considerable forces act on the intermediate layers formed of resilient material. In practice, it is not only impossible to overcome these forces so that only axial forces would exert in the coil, but various loads on the intermediate layers at various places of the coil in the axial and circumferential directions would unavoidably result in the induction coil. Such a non-uniform force distribution leads to the fact that radially-acting forces occur, which cause a lateral movement of the portions of the induction coil and the intermediate layers.

In order to overcome the above-described problem it has been proposed, for example in DE-PS No. 2,420,533 to provide externally of the coil a number of iron yokes uniformly distributed around the coil in the circumferential direction. These yokes firstly serve for a field-force guiding, and secondly for pressing the coil toward the crucible of the furnace. With this means, however, it has not been attained that forces acting on the intermediate layers of resilient material would be uniformly distributed on the intermediate layers of the coil. It has been observed that these forces have been more or less non-uniformly distributed whereby at certain places of the coil where only small compressing forces occurred, a gas-tight sealing has not been possible. A considerable axial pressure prevails at some individual spots of the intermediate layers so that the material of these layers has been strongly loaded while at other spots of the intermediate layers a very small pressure has exerted, which has been not sufficient for the gas-tight sealing of the furnace.

SUMMARY OF THE INVENTION

It is an object of the present invention to provide an improved coreless induction furnace in which a substantially uniform pressure in intermediate layers positioned between individual windings of the coil would be ensured.

This and other objects of the invention are attained by a coreless induction furnace for melting, heating or treating metals or metal melts, particularly in vacuum or under high pressure, comprising a crucible, and a cooled induction coil including a plurality of windings and a plurality of intermediate layers positioned between said windings and formed of resilient gas-tight material, said windings together with said intermediate layers forming a portion of an outer gas-tight jacket surrounding said crucible, and a clamping device for compressing said windings and said intermediate layers together in an axial direction of the induction coil, said induction coil being additionally provided with spacer means positioned between individual windings.

The spacer means which has a small height in the axial direction of the spool, as well the intermediate layers, define a precise space in the axial direction, which the respective intermediate layers occupy. In this fashion it is ensured that the intermediate layers be uniformly and strongly compressed at all places when the coil is in its compressed position. It is thereby provided that at all places of the induction coil a gas-tight jacket for the furnace crucible be produced.

The individual windings have surfaces facing toward each other, said intermediate layers may cover only portions of said surfaces whereas a remaining portion of each of said surfaces is covered by a respective spacer means.

The core has a central line and a peripheral edge; said intermediate layers may each be positioned substantially in a region between said central line and said peripheral edge, said spacer means being each arranged in an outer region of each region between the individual windings. When the coil arrangement in the operation of the furnace is heated up the resilient material of the intermediate layers expands in accordance with material conditions. It is obtained, due to the above-described position of the intermediate layers and spacer means, that heating of the material of the intermediate layers, that is a sealing means, causes increase in a bearing pressure of this sealing means relative to other parts of the assembly.

U.S. Pat. No. 4,152,187 discloses an induction furnace, in which strips of insulating material are inserted between the windings of the coil. Although these strips could be indicated as a spacer means in the known arrangement intermediate layers inserted between individual coil windings are not formed of resilient material and they have the purpose of gas-tight sealing of the crucible. A jacket is often provided for a gas-tight sealing of the furnace, this jacket being positioned between the outer wall of the crucible and the inner sides of the coil windings. This sealing jacket is formed of a reinforced resilient material which unevenly compresses the strips of insulating material. This known arrangement is disadvantageous to the present invention in regard to sealing against gas penetration.

It is particularly advantageous that the furance may include yokes for a field-force guiding, said yokes radially supporting said coil in the direction toward said crucible. Such yokes are known from DE-PS No. 2,420,533. In connection with the spacer means of the present invention the use of the yokes has the advantage that a stable, displacement-free and symmetrical induction coil with the intermediate layers uniformly sealed at all places is held in position by the yokes.

In order to protect the sealing material of the intermediate layers, before a heating-up is rather strong, the furnace may include cords of fire-resistant material, said cords each being positioned between said individual windings at a side of the coil facing said crucible. These cords, which may be of asbestos, ensure that the sealing material would not be damaged by a strong heating effect and does not lose its sealing properties.

The core may have a jacket or a coating of insulating material. The spacer means may be additionally or alternatively made of electrically-insulating material.

It is theoretically possible to position small spacer discs at relatively great intervals or between the individual coil windings. Preferably, the spacer means may be spacer elements or pieces which are either positioned immediately adjacent to each other or in spaced relationship with each other.

Such spacer elements enable the provision of the smooth, uninterrupted, spiral layers between the windings of the coil, whereby the individual spacer elements can be easily assembled.

Each of said spacer elements may be formed of an individual continuous tape-like spiral cord. If the spacer means with an insulated coil conductor made from a conductive material are used they may be made of fabric-reinforced plastics or of mica with a binding agent.

The furnace may further include a thermal insulation layer mounted to an inner side of said coil. This layer may be of ceramics or fire-resistant concrete.

The intermediate layers may be made of, for example, putty, or rubber, or plastics.

A ratio between a height of said intermediate layers and said spacer elements in an axial direction of the spool, when the latter is in a non-compressed position, may be in the range between 2:1 and 1.2:1, preferably 5:3.5.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
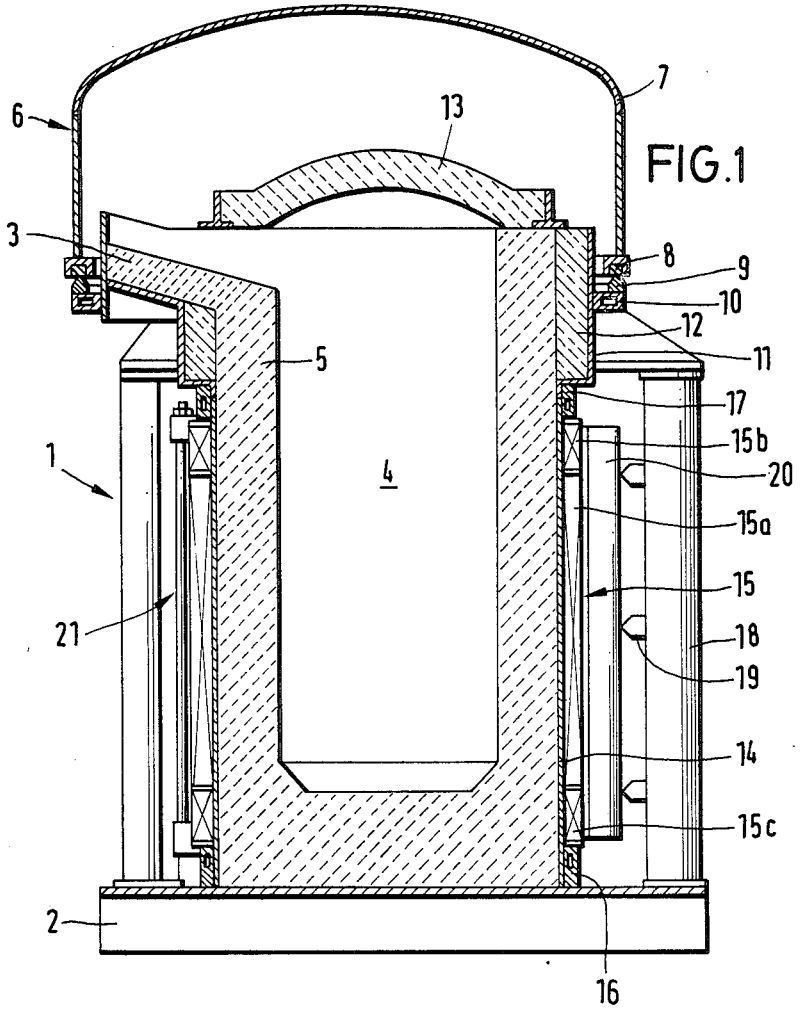
FIG. 1 is an axial view through the induction furnace of the invention.

Referring now to the drawings in detail, and first to FIG. 1, it will be seen that a coreless vacuum induction furnace 1 is supported on a furnace lower support 2 formed of a steel structure. Furnace 1 includes a crucible 4 provided with a cast opening 3 and having a lining 5 made of fire-resistant mass. Metal is melted and/or holds heat in crucible 4 under vacuum.

In order to generate vacuum in the furnace the whole interior of the furnace must be gas-tight sealed. For this purpose an upper portion 6 of the furnace is provided with a covering hood 7 which is tightly inserted in a U-shaped rubber sealing mounted with its edge on an annular flange 9, and the annular flange 9 is welded to an annular support or jacket 10. The latter is in turn welded to the outer wall of an upper steel jacket or casing 11. A heat-insulating layer 12 is positioned between the upper steel jacket 10 and lining 5. The upper side of crucible 4 is covered with a cover 13 formed of ceramic material. Another lower jacket 14, which will be described below, is provided at the outer periphery of the lower portion of crucible 4. Jacket or layer 14 serves the purpose of thermal insulation.

Figure 3:
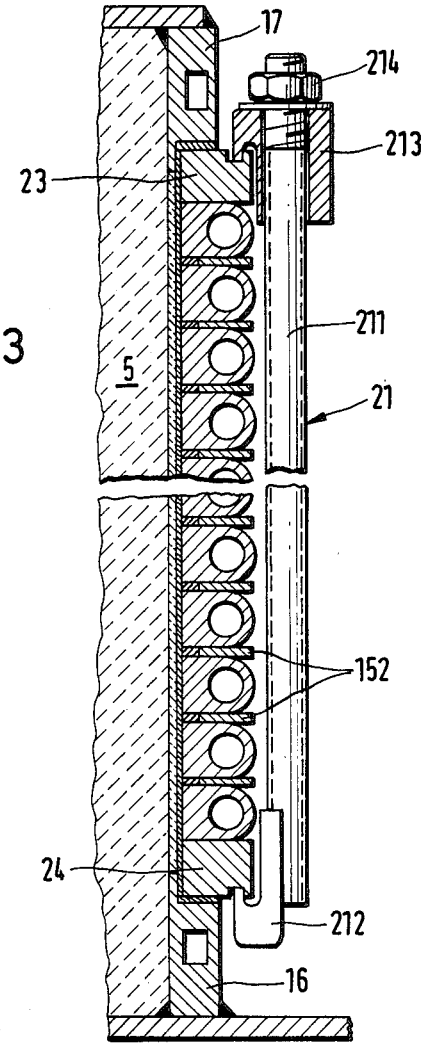
FIG. 3 is a radial cross-section through the induction furnace with a coil-clamping device.

The lower region of crucible 4, in which melted or warmed metal is positioned is surrounded by an induction coil 15 provided with a cooling means. A lower vacuum sealing 16 and an upper vacuum sealing 17 surround the crucible 4 and induction coil 15. Sealings 16 and 17 are spaced from each other in the axial direction of the furnace. The induction coil in the known manner, as disclosed in DE-PS No. 2,420,533, is subdivided into an active current-receiving coil portion **15*a* and two coil portions 15*b* and 15*c* which are not supplied with current. Coil portions 15*b* and 15*c* operate primarily as cooling coils. Supporting columns 18, connected to the upper portion of the furnace are uniformly angularly distributed over the periphery of thc furnace. These supporting columns support by means of intermediate elements 19 of yokes 20 also uniformly angularly distributed over the periphery of the furnace and supporting the induction coil 15 from the exterior thereof. Yokes 20 are formed of stacked iron plates. The yokes serve as radial supports of the induction coil 15 and also for magnetic field force guiding, The induction coil 15 is comprised of a plurality of windings, between which intermediate layers gas-tightly closing the vacuum furnace are positioned. This arrangement formed of the coil conductor is assembled together in the radial direction of the coil by a coil-clamping device 21. The coil-clamping device 21 is schematically shown in FIGS. 1 and 3**.

Figure 4:
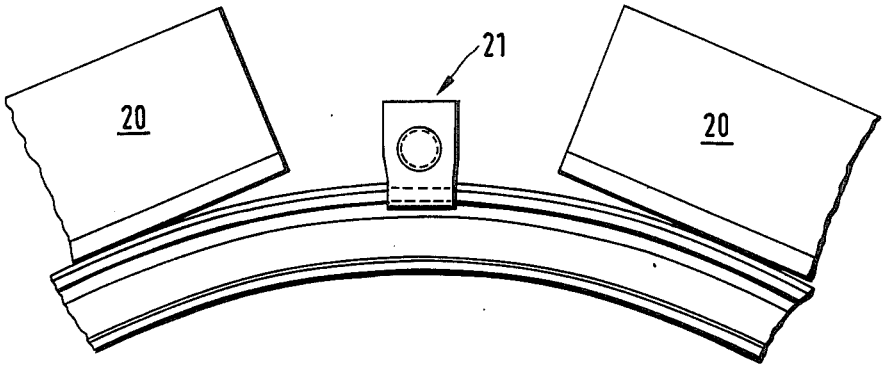
FIG. 4 is a plan view of the underside of the coil arrangement of the furnace of FIG. 1.

FIG. 4 illustrates a portion of the furnace seen from below. Two neighboring yokes 20 are positioned at two sides of arrangement 21.

Figure 2:
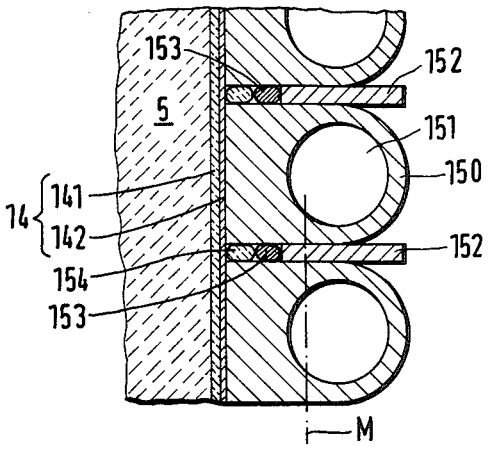
FIG. 2 is a radial cross-section through a portion of the induction furnace of FIG. 1.

FIG. 2 shows the embodiment of the induction coil formed as a gas-tight sealed element which surrounds the crucible 4. FIG. 2 depicts individual windings of the coil conductor 150 which has a cooling passage 151 of a circular cross-section through which a cooling agent, for example water, flows.

The coil-clamping device 21 presses the individual windings of the coil 150 against each other, whereby the end positions of the windings are defined by spacer elements 152 made of mica. The spacer elements 152 are strip-like pieces which extend, for example over angle 90° so that four spacer elements correspond to one winding.

In the embodiment according to FIG. 2 the spacer elements 152 are arranged closely adjacent to each other so that a single spacer strip is formed. In the radial direction of the furnace the spacer elements 152 receive the outer region of the coil, also mainly the region extended to the right from the coil center line M (FIG. 2). At the side of each spacer element 152, facing toward the crucible, a resilient intermediate layer 152 and a cord 154, made of fire-resistant material, for example asbestos, are provided. Cord 154 protects each intermediate layer made of rubber against damage by excessive heat action. Lining 14 formed by a thermal insulating layer 141 and a fire-resistant concrete layer 142 are positioned between the induction coil 15 and the lining 5.

As shown in FIG. 2 the intermediate layers 153 as well as cords 154 are somewhat oval in cross-section.

Before pressing the coils or windings of the induction coil 15 together the intermediate layers 153 and cords 154 have a circular cross-section. Due to the fact that the spacer elements 152 has a binding means the extent of the compression of the intermediate layers 153 and cords 154 is exactly defined. The compressed elements are uniformly strongly compressed at all places with evenly thick spacer means.

With reference to FIG. 3 it will be seen that the lower vacuum sealing 16 and the upper vacuum sealing 17 are each respectively connected to a compensation ring 24 or 23. Hooks 212 and 213 of the clamping device 21 are engaged in the respective grooves of the compensation rings 23, 24. By means of a nut 214 hooks 212, 213 can be moved toward each other to compress the coils of the induction coil 15 with the inserted intermediate layers and the spacers.

In the above-described embodiment the spacer elements 152 are made of mica with the binding agent; these spacers can also be formed of synthetic resin with imbedded fabric reinforcements. The intermediate layers can be made either of rubber or of a suitable plastic. In a non-compressed state each cord 154 and each intermediate layer 153 has a circular cross-section and a diameter of about 5 mm. In the compressed position the height of each of these elements corresponds to the height of the spacer element 153 and is about 3.5 mm. The coil 150 according to FIG. 2 is not insulated In place of such structure the coil can have a coating or jacket made of insulating material In such case the elements positioned between the individual windings of the coil, particularly the spacers, are not unconditionally made of insulating material but can be rather formed of an electrically-conductive material, although an insulating material is preferable, It will be understood that each of the elements described above, or two or more together, may also find a useful application in other types of induction furnaces differing from the types described above.

While the invention has been illustrated and described as embodied in an induction furnace, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A coreless induction furnace for melting, heating or treating metals or metal melts, particularly in vacuum or under high pressure, comprising a crucible, and a cooled induction coil including a plurality of windings, a plurality of spacer means positioned between individual windings and a plurality of intermediate layers also positioned between said windings and formed of resilient gas-tight material, said intermediate layers being each positioned laterally adjacent a respective spacer means between individual windings so that each intermediate layer is closer to a central axis of said coil while said spacer means each extends to a peripheral edge of said coil, said windings together with said intermediate layers forming a portion of an outer gas-tight jacket surrounding said crucible, and a clamping device compressing said windings and said resilient intermediate layers together in an axial direction of the induction coil so that gas-tight material of said intermediate layers between said windings is compressed.

2. The furnace as defined in claim 1, wherein said individual windings have surfaces facing toward each other, said intermediate layers covering only portions of said surfaces whereas a remaining portion of each of said surfaces is covered by a respective spacer means.

3. The furnace as defined in claim 1, wherein said resilient material is rubber.

4. The furnace as defined in claim 1, further including yokes for a field force guiding, said yokes radially supporting said coil in the direction toward said crucible.

5. The furnace as defined in claim 4, further including cords of fire-resistant material, said cords each being positioned between said individual windings at a side of the coil facing said crucible.

6. The furnace as defined in claim 5, wherein said fire-resistant material is asbestos.

7. The furnace as defined in claim 5 wherein said coil has a jacket of insulating material.

8. The furnace as defined in claim 5, wherein said coil has a coating of insulating material.

9. The furnace as defined in claim 7, wherein said spacer means are made of electrically-insulating material.

10. The furnace as defined in claim 9, wherein said spacer means are spacer elements.

11. The furnace as defined in claim 10, wherein said spacer elements are positioned immediately adjacent to each other.

12. The furnace as defined in claim 10, wherein said spacer elements are positioned in spaced relationship with each other.

13. The furnace as defined in claim 10, wherein each of said spacer elements is formed of an individual continuous tape-like spiral cord.

14. The furnace as defined in claim 10, wherein each spacer element is formed of a fabric-reinforced plastics.

15. The furnace as defined in claim 10, wherein said spacer element is formed of mica with a binding material.

16. The furnace as defined in claim 10, further including a thermal insulation layer mounted to an inner side of said coil.

17. The furnace as defined in claim 16, wherein said thermal insulation layer is formed of ceramic material.

18. The furnace as defined in claim 16, wherein said thermal insulation layer is made of fire-resistant concrete.

19. The furnace as defined in claim 17, wherein said intermediate layers are each made of a cord of rubber.

20. The furnace as defined in claim 17, wherein said intermediate layers are made of plastics.

21. The furnace as defined in claim 16, wherein a ratio between overall heights of said intermediate layers and said spacer elements in an axial direction of the spool when the latter is in a non-compressed position is in the range between 2:1 and 1.2:1.

22. The furnace as defined in claim 21, wherein said ratio is about 5:3.5.

* * * * *